US012240022B2

(12) United States Patent
Vogt et al.

(10) Patent No.: US 12,240,022 B2
(45) Date of Patent: Mar. 4, 2025

(54) SHEET STEEL HAVING A DETERMINISTIC SURFACE STRUCTURE

(71) Applicant: THYSSENKRUPP STEEL EUROPE AG, Duisburg (DE)

(72) Inventors: Oliver Vogt, Dortmund (DE); Fabian Junge, Wesel (DE); Burak William Centinkaya, Dortmund (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 0 days.

(21) Appl. No.: 17/763,428

(22) PCT Filed: Sep. 28, 2020

(86) PCT No.: PCT/EP2020/007098
§ 371 (c)(1),
(2) Date: Mar. 24, 2022

(87) PCT Pub. No.: WO2021/069247
PCT Pub. Date: Apr. 15, 2021

(65) Prior Publication Data

US 2024/0051003 A1 Feb. 15, 2024

(30) Foreign Application Priority Data

Oct. 10, 2019 (DE) ..... 10 2019 215 580.4

(51) Int. Cl.
*B21B 1/22* (2006.01)
*B21B 27/00* (2006.01)
*B21B 45/02* (2006.01)

(52) U.S. Cl.
CPC ..... *B21B 1/227* (2013.01); *B21B 27/005* (2013.01); *B21B 45/0251* (2013.01); *B21B 2001/228* (2013.01); *B21B 2263/02* (2013.01)

(58) Field of Classification Search
CPC . B21B 1/227; B21B 2001/228; B21B 27/005; B21B 45/0251
See application file for complete search history.

(56) References Cited

U.S. PATENT DOCUMENTS 5,552,235 A * 9/1996 Bastawros ..... B21B 1/227 427/327
2005/0000262 A1 1/2005 Schreiber et al.
2005/0105638 A1 5/2005 Owen et al.
2015/0209848 A1 7/2015 Kopplin et al.
2019/0176198 A1 6/2019 Beier et al.
(Continued)

FOREIGN PATENT DOCUMENTS

DE 102012017703 A1 3/2014
DE 102019214136 A1 3/2021
EP 1136574 A1 9/2001
(Continued)

OTHER PUBLICATIONS

English translation of JPH0475704 obtained form EPO espacenet May 18, 2024. (Year: 2024).*
(Continued)

*Primary Examiner* — Adam Krupicka
(74) *Attorney, Agent, or Firm* — RMCK Law Group PLC

(57) ABSTRACT

The invention relates to a sheet steel skin-pass rolled with a deterministic surface structure, and to a method for producing it.

4 Claims, 3 Drawing Sheets

(56) References Cited

U.S. PATENT DOCUMENTS

Figure 1:
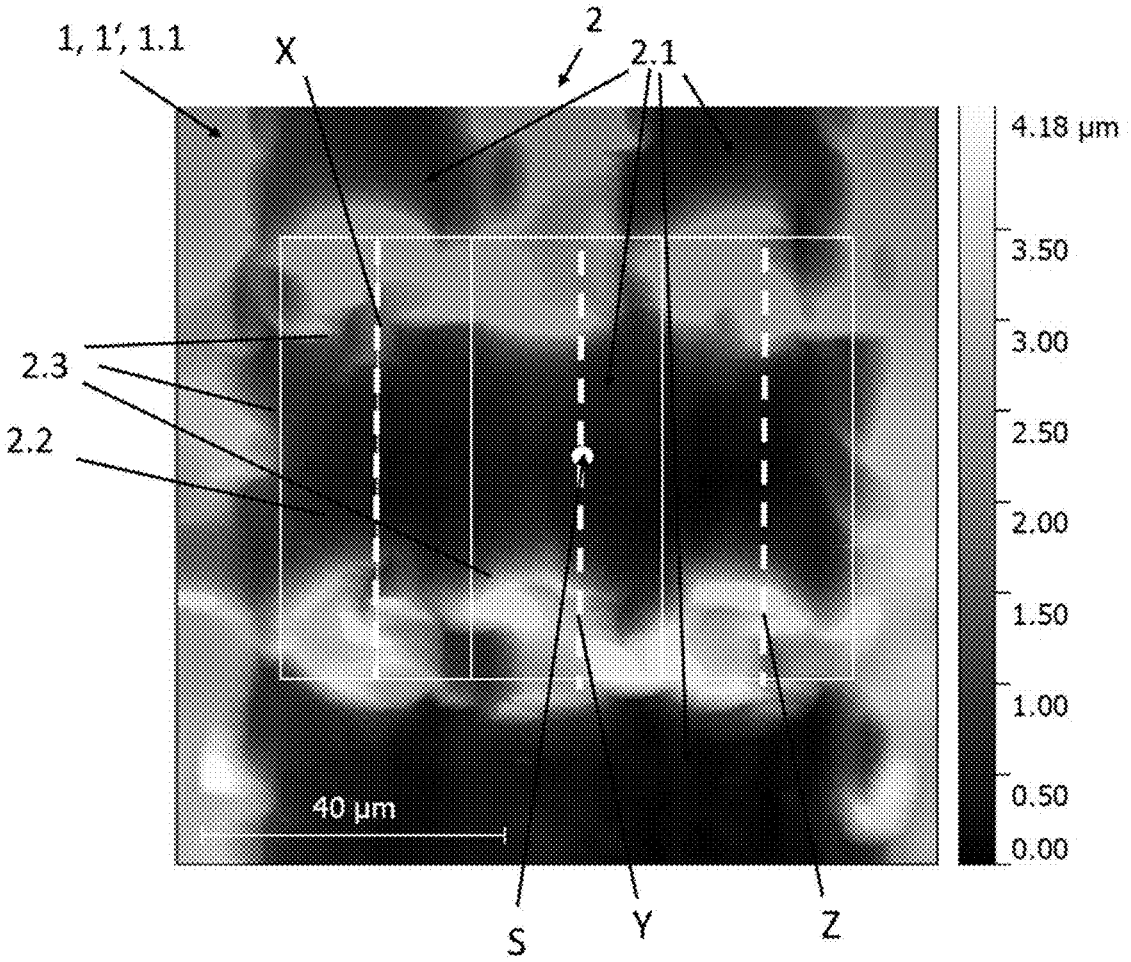

2023/0201899 A1 6/2023 Vogt et al.

FOREIGN PATENT DOCUMENTS

| | | | |
|---|---|---|---|
| EP | 2892663 | B1 | 11/2016 |
| JP | S62230402 | A | 10/1987 |
| JP | H10475704 | A | 3/1992 |
| JP | H09300002 | A | 11/1997 |
| JP | 2000015304 | A | 1/2000 |
| JP | 2005288531 | A | 10/2005 |
| WO | 03004186 | A1 | 1/2003 |
| WO | 2018110995 | A1 | 6/2018 |

OTHER PUBLICATIONS

International Search Report and Written Opinion for International Application No. PCT/EP2020/077098 mailed Dec. 16, 2020.
Chinese Search Report for CN Application No. 202080071225X mailed Jun. 6, 2024.
German Office Action for DE Application No. 10 2019 215 580.4 mailed Jul. 31, 2024.
Japanese Office Action for JP Application No. 2022-521367 mailed Sep. 17, 2024.

* cited by examiner

SHEET STEEL HAVING A DETERMINISTIC SURFACE STRUCTURE

CROSS-REFERENCE TO RELATED APPLICATIONS

This application is a 371 U.S. National Stage of International Application No. PCT/EP2020/077098, filed Sep. 28, 2020, which claims the benefit of German Patent Application No. 10 2019 215 580.4 filed Oct. 10, 2019. The disclosures of each of the above applications are incorporated herein by reference in their entirety.

Generic sheet steels skin-pass rolled with a deterministic surface structure are known from the prior art: see, for example, patent specification

EP 2 892 663 B1.

There is a need to optimize the known prior art, particularly in terms of targeted modeling of the surface structure of a sheet steel skin-pass rolled with a deterministic surface structure.

The object is therefore to provide a sheet steel skin-pass rolled with a deterministic surface structure, said sheet steel providing a targeted change in the surface structure in comparison with the prior art.

The object is achieved by means of the features of claim 1.

The provision of a targeted surface structure on a skin-pass rolled sheet steel is essential for further processes, in particular in the industry carrying out further processing in order to produce components for automobiles. In component production, in particular in forming processes, it is advantageous if process media that are used, such as oil and/or lubricants, for example, are present in necessary surface weights at locations relevant to the forming process. These locations relevant to the forming process are generally the contact areas between sheet steel and shaping tools—accordingly, not the impressions or indentations in the sheet steels in which the process media preferably collect, but rather the surface in the form of the area of the elevations on the sheet steels. The inventors have found that for a sheet steel skin-pass rolled with a deterministic surface structure, it is possible to provide, in comparison with the prior art, a targeted surface structure if the surface structure has a multiplicity of indentations, wherein each indentation has an encircling flank region which leads, starting from the surface, down to a valley region, wherein, as viewed in a sectional illustration, each indentation has a depth profile which comprises two opposite flank subregions and a valley subregion which runs between the flank subregions and which connects the flank subregions, wherein the depth profile is divided into a left-hand part and a right-hand part of the depth profile, wherein the depth profile runs in an asymmetrical manner, wherein the flank subregions and valley subregions of the left-hand part and of the right-hand part of the depth profile differ at least in height, width and/or gradient.

Due to the targeted modeling of the surface structure and the correspondingly formed asymmetrical profile of the depth profile, it has been found that the asymmetry does indeed have an unfavorable influence on the forming result during the forming operation, the regions of the surface of the sheet steel which in particular border the flank subregions and valley subregions with a steeper gradient and/or greater width and which come into contact with the shaping tool being exposed to a relatively high forming force since they offer a relatively high resistance, but it was found, surprisingly, that the process media had accumulated in the flank subregions and valley subregions with a steeper gradient and/or greater width in a targeted manner with a resulting height dependent on the quantity and/or type, for example dependent on the flowability, of the process medium, and thus are available at the process-relevant region, as a result of which the resistance can be reduced, and so the unfavorable ratio of deformation can be compensated for by the targeted influencing of the local distribution of process media. Owing to capillary action, process media collect, in particular, at wide and steep flank subregions and valley subregions. The height is particularly relevant since the height defines the area of the flank subregion from which the capillary effect proceeds. However, given a constant quantity of the process medium, an excessively high height may have a disadvantageous effect on the forming process, since the medium would have to travel a relatively long distance from the valley (sub)region in order to reach the process-relevant region.

The term "deterministic surface structure" refers to repeating surface structures which have a defined shape and/or design; cf.

EP 2 892 663 B1. In particular this also includes surfaces having a (quasi-)stochastic aspect but which are nevertheless applied by means of a deterministic texturing process and which therefore are composed of deterministic shaped elements.

The term "sheet steel" generally refers to a flat steel product which may be provided in sheet form or else in plate form or in strip form.

The flank region encircling the indentation, together with the valley region connected in one piece to the flank region, defines a closed volume of the surface structure impressed by means of skin-pass rolling into the sheet steel. For subsequent processing by means of forming methods, the closed volume, what is known as the empty volume, may be adapted to a process medium, in particular oil, that is to be applied.

Further advantageous embodiments and developments are apparent from the description below. One or more features from the claims, the description and the drawing may be linked with one or more other features therefrom to form further embodiments of the invention. It is also possible for one or more features from the independent claims to be linked by one or more other features.

According to one embodiment of the sheet steel according to the invention, the depth profile is viewed in and/or transversely to the skin-pass rolling direction. The action of a skin-pass roll can be used to exert a targeted influence in particular in and/or transversely to the skin-pass rolling direction, since the shaping elements of the skin-pass roll can be used to produce, preferably in the skin-pass rolling direction, but alternatively or additionally also transversely to the skin-pass rolling direction, a targeted asymmetry of the indentations, said shaping elements acting on the surface of the sheet steel, dipping into the surface of the sheet steel and generating the indentations.

The geometrical configuration (size and depth) of a deterministic surface structure (negative shape) on a skin-pass rolled sheet steel is dependent in particular on how the corresponding geometrical structure (positive shape, shaping elements) has been/is designed on a skin-pass roll. Laser texturing processes are preferably used in order to be able to produce targeted structures (positive shape) on the surface of a skin-pass roll by removal of material. In particular, targeted activation of the energy, the pulse duration, and the selection of a suitable wavelength of a laser beam acting on the surface of the skin-pass roll can be used to exert a positive influence on the design of the structure(s). fs, ps, and ns pulses are all suitable for removal of material, but the nature of the incoupling of energy and of the removal on a solid surface is substantially different, as is the size of the heat-affected zone (HAZ). The shorter the pulse duration, the smaller the amount of energy which can flow, for example, from the laser focus into the surrounding area (HAZ). The longer the pulse, the greater the extent to which the radiant energy is coupled into the plasma which is already forming, or is reflected from said plasma, and therefore cannot be coupled directly into the surface of the skin-pass roll. On the surface of the skin-pass roll, a pulse leaves behind a substantially circular crater, which reproduces—or which reproduce, when there are multiple craters—the surface or the area of the elevations (surface) on the sheet steel, and thus the contact area between sheet steel and shaping tool, after the skin-pass rolling operation. Reducing the pulse duration affects the formation of a crater, in particular the diameter of the crater can be reduced. By reducing the pulse energy, in particular when using short-pulse or ultrashort-pulse lasers, it is possible to produce the geometrical structure (positive shape) on the surface of a skin-pass roll in a targeted manner. This is achieved, for example, if the pulse duration of the laser with which the surface of the skin-pass roll is textured is reduced in the direction of the removal threshold, and thus the geometrical structure can be generated with higher resolution on the skin-pass roll. A similar effect can be achieved by raising the beam profile quality ($M^2$) and the aperture of the ideally aspherical focusing optics. In particular by virtue of the high resolution and/or low crater area, formed by the relatively low-energy interaction of laser and skin-pass roll, it is possible to produce flank (sub)regions with any desired height, width and/or gradient (angle of the flank region) in a targeted manner.

According to one embodiment of the sheet steel according to the invention, as viewed in the plane of the surface, the indentation has an area which has a centroid through which the depth profile is viewed in and/or transversely to the skin-pass rolling direction. The depth profile which runs through the centroid, which can be unambiguously ascertained in the plane of the surface of the viewed area of the indentation, for example in or alternatively or additionally transversely to the skin-pass rolling direction, can exhibit an asymmetry, in particular the differences between the flank subregions and the valley subregions of the left-hand part and of the right-hand part of the depth profile with regard to height, width and/or gradient.

According to one embodiment of the sheet steel according to the invention, the left-hand part of the depth profile runs from the highest point to the lowest point, and the right-hand part of the depth profile runs from the highest point to the lowest point, the depth profile having a symmetry factor $A \leq 0.9$, where A corresponds to the ratio of the integrals of the left-hand and right-hand part of the depth profile, the integral with the larger value being the denominator of the ratio. In particular, the depth profile has a symmetry factor $A \leq 0.85$, preferably $A \leq 0.8$, preferably $A \leq 0.75$, further preferably $A \leq 0.7$, particularly preferably $A \leq 0.67$. The lower the symmetry factor set, the greater the extent to which the metal sheets are conditioned along a predefined direction, so that, compared with the opposite direction, for example better friction properties and/or better flow resistance properties (laminar or turbulent flow of fluids) can be obtained along said direction.

According to one embodiment of the sheet steel according to the invention, the sheet steel is coated with a metallic coat, in particular with a zinc-based coat, which is applied by hot-dip coating. The coat may preferably comprise not only zinc and unavoidable impurities but also additional elements such as aluminum with a content of up to 5% by weight and/or magnesium with a content of up to 5% by weight in the coat. Sheet steels with a zinc-based coat have very good cathodic corrosion protection and have been used in automotive construction for years. If improved corrosion protection is intended, the coat additionally comprises magnesium with a content of at least 0.3% by weight, in particular of at least 0.6% by weight, preferably of at least 0.9% by weight. Aluminum may be present as an alternative or in addition to magnesium with a content of at least 0.3% by weight, in order in particular to improve the attachment of the coat to the sheet steel and in particular to substantially prevent iron from diffusing out of the sheet steel into the coat if the coated sheet steel undergoes heat treatment, so that the positive corrosion properties are retained. In this respect, the thickness of the coat may be between 1 and 15 μm, in particular between 2 and 12 μm, preferably between 3 and 10 μm. Below the minimum limit, sufficient cathodic corrosion protection is not able to be ensured, and above the maximum limit, there may be joining problems when the sheet steel according to the invention or a component fabricated from it is being joined to another component, in particular, if the specified maximum limit on the thickness of the coat is exceeded, a stable process during thermal joining or welding is not able to be ensured. During hot-dip coating, the sheet steels are first coated with a suitable coat and then supplied to skin-pass rolling. The skin-pass rolling takes place after the sheet steel has been hot-dip coated.

According to an alternative embodiment of the sheet steel according to the invention, the sheet steel is coated with a metallic coat, in particular a zinc-based coat, which is applied by electrolytic coating. In this respect, the thickness of the coat may be between 1 and 10 μm, in particular between 1.5 and 8 μm, preferably between 2 and 5 μm. In comparison with hot-dip coating, it is possible for the sheet steel to first be skin-pass rolled and then electrolytically coated. Depending on the thickness of the coat, the roughness in the flank region may be substantially preserved even after the electrolytic coating. As an alternative, initial electrolytic coating with subsequent skin-pass rolling is also conceivable.

It is also conceivable for no coat, for example no metallic coat, to be provided. It is also conceivable for the sheet steel to have been/be coated with a non-metallic coat, for example in a strip coating installation, the sheet steel being skin-pass rolled before or after being coated with a non-metallic coat.

According to one embodiment of the sheet steel according to the invention, the in particular coated sheet steel is additionally provided with a process medium, in particular with an oil, wherein in particular the process medium is taken up with a surface weight of up to 2 $g/m^2$ in the surface structure. On account of the dimensioning of the surface structure, there is only a small requirement for process medium, and so the surface weight is limited to up to 2 $g/m^2$, in particular up to 1.5 $g/m^2$, preferably up to 1 $g/m^2$, preferably up to 0.6 $g/m^2$, further preferably up to 0.4 $g/m^2$. Because of the asymmetry, in particular, the process medium after being applied is deposited substantially in the indentations locally in the flank subregions and valley subregions with a steeper gradient, higher height and/or greater width, and is available for further processes, such as for shaping processes, for example, preferably for deep-drawing processes, closer to or adjacent to locations that are relevant to the forming process, in order to improve the lubrication and reduce the friction and thus the wear of the shaping means, such as shaping devices, for example, preferably (deep-drawing) presses. In particular, the process medium can be effectively prevented from accumulating at tribologically unfavorable regions that do not make a contribution to the supply of process medium to the actual zone of contact or of friction. Consequently, the sheet steel according to the invention, with little demand for process medium, has very good tribological properties and is more environmentally friendly in comparison with the in particular oiled sheet steels known from the prior art, in particular by virtue of reduced use of resources.

According to a second aspect, the invention relates to a method for producing a sheet steel skin-pass rolled with a deterministic surface structure, comprising the following steps: —providing a sheet steel, —skin-pass rolling the sheet steel with a skin-pass roll, wherein the surface of the skin-pass roll which acts on the surface of the sheet steel is furnished with a deterministic surface structure such that, after the skin-pass rolling, the surface structure is impressed into the sheet steel starting from a surface of the sheet steel, wherein the surface structure has a multiplicity of indentations, wherein each indentation has an encircling flank region which leads, starting from the surface, down to a valley region, wherein, as viewed in a sectional illustration, each indentation has a depth profile which comprises two opposite flank subregions and a valley subregion which runs between the flank subregions and which connects the flank subregions, wherein the depth profile is divided into a left-hand part and a right-hand part of the depth profile, wherein the depth profile runs in an asymmetrical manner, wherein the flank subregions and valley subregions of the left-hand part and of the right-hand part of the depth profile differ at least in height, width and/or gradient.

Owing to the action of force on the surface of the sheet steel, the surface (positive shape) of the skin-pass roll forms a surface structure which defines indentations with respective valley and flank regions (negative shape) and corresponds substantially to the surface (positive shape) of the skin-pass roll. The skin-pass roll for forming a deterministic surface structure may be machined using suitable means, for example by means of a laser; cf. also EP 2 892 663 B1. Furthermore, other methods of removal of material may also be used for producing a surface on a skin-pass roll, for example machining methods using a geometrically defined or undefined cutting edge, chemical or electrochemical, optical or plasma-induced methods, which are suitable for being able to produce a sheet steel to be skin-pass rolled having a surface structure and a corresponding asymmetry.

In order to avoid repetition, reference is made in each case to the observations regarding the sheet steel according to the invention that is skin-pass rolled with a deterministic surface structure.

According to one embodiment of the method according to the invention, prior to the provision of the sheet steel, the sheet steel is coated by hot-dip coating. The melt for the hot-dip coating may preferably comprise not only zinc and unavoidable impurities but also additional elements such as aluminum with a content of up to 5% by weight and/or magnesium with a content of up to 5% by weight.

According to an alternative embodiment of the method according to the invention, after the sheet steel has been skin-pass rolled, the skin-pass rolled sheet steel is coated by electrolytic coating.

According to one embodiment of the method according to the invention, after the skin-pass rolling, the sheet steel is additionally provided with process medium, preferably with oil, wherein the process medium is applied with a surface weight of up to 2 g/m$^2$, further preferably with a surface weight of up to 0.4 g/m$^2$.

Specific embodiments of the invention will be described in more detail below with reference to the drawing. The drawing and accompanying description of the resulting features should not be read as limiting to the respective embodiments, but serve to illustrate the exemplary embodiments. Furthermore, the respective features may be used with one another and with features of the above description for possible further developments and improvements of the invention, specifically in additional embodiments which are not illustrated. Identical parts are always denoted by the same reference designations.

Figure 2:
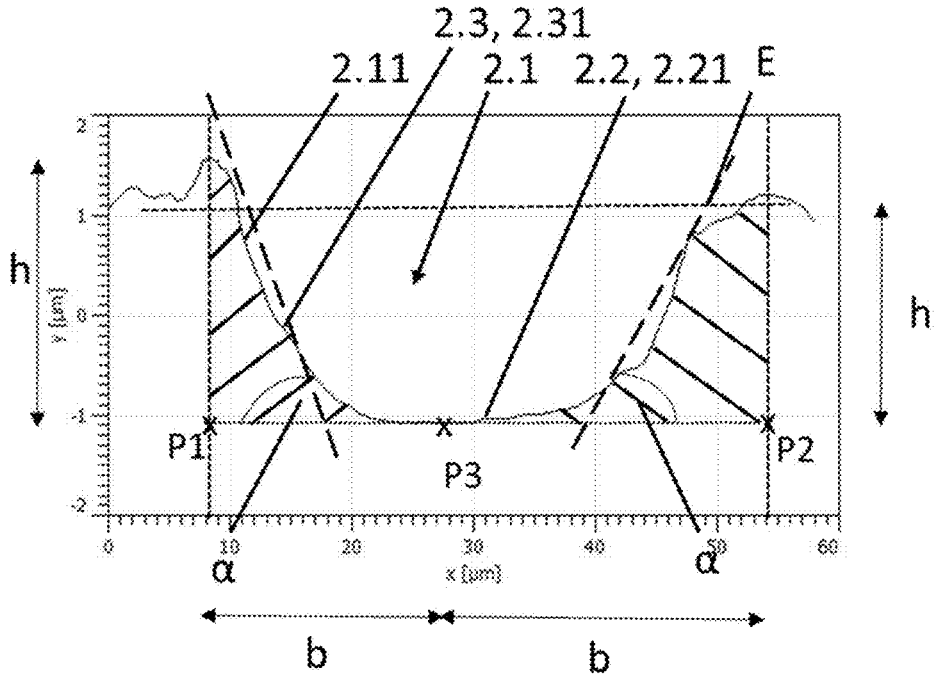
Figure 3:
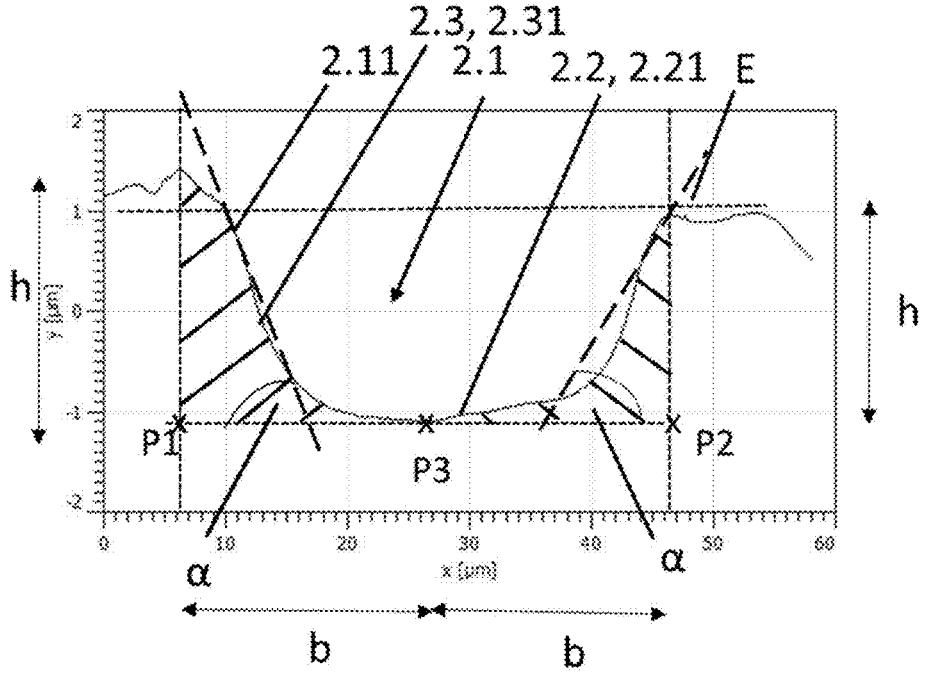
Figure 4:
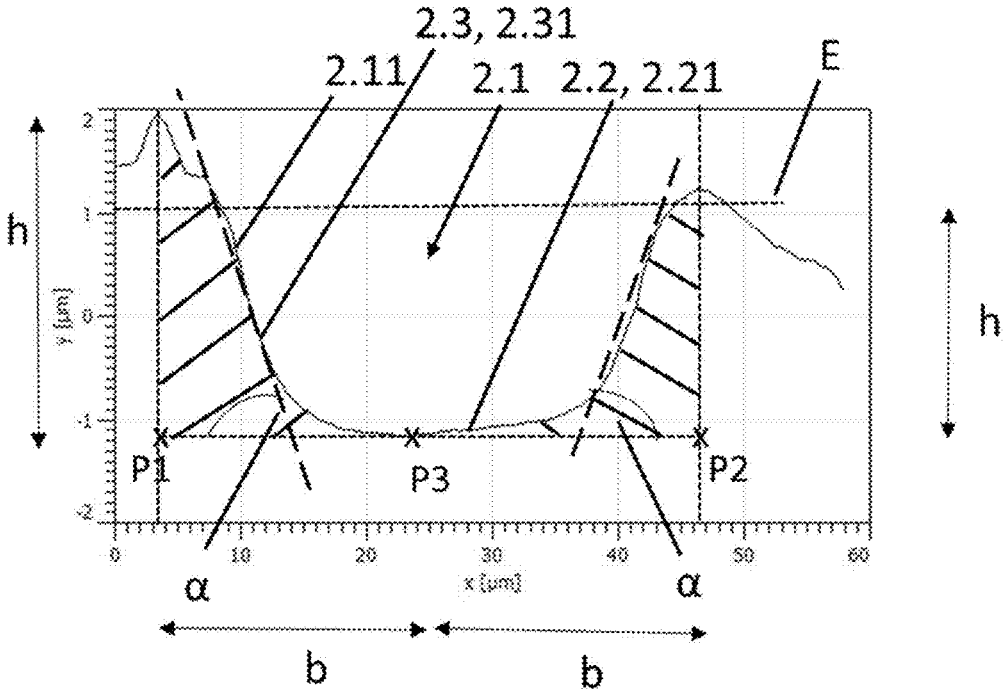

In the drawing:

FIG. 1) shows an AFM micrograph of a detail of a coated sheet steel, skin-pass rolled with a deterministic surface structure, in accordance with an exemplary embodiment according to the invention, FIG. 2) shows a partial sectional illustration along section X in FIG. 1, FIG. 3) shows a partial sectional illustration along section Y in FIG. 1, and FIG. 4) shows a partial sectional illustration along section Z in FIG. 1.

FIG. 1) illustrates an atomic force microscopy (AFM) micrograph of a detail of a coated sheet steel (1, 1'), skin-pass rolled with a deterministic surface structure (2), in accordance with an exemplary embodiment according to the invention. It is possible for the sheet steel (1, 1') to be an uncoated sheet steel (1), that is to say to not have an in particular metallic coat or non-metallic coat, or to be a sheet steel (1') coated with a metallic coat (1.2). The deterministic surface structure (2) exhibits a constantly repeating I-shaped impression in the form of an indentation (2.1). The centroid (S) in the plane of the surface (1.1) can be ascertained in a relatively rapid and simple manner in the case of a substantially rectangular indentation. Other embodiments of the indentation(s) are likewise conceivable and applicable, and are not restricted to an I-shaped impression. The surface structure (2) was impressed by means of a skin-pass roll (not illustrated), the surface of the skin-pass roll having been structured by means of a laser; cf. EP 2 892 663 B1. Each indentation (2.1) has an encircling flank region (2.3) which leads, starting from the surface (1.1), down to a valley region (2.2).

The scanning region of the atomic force microscopy (AFM) had an area of 90×90 μm$^2$, three regions (framed in white) within the scanning region, each having an area of 25×60 m$^2$, being examined in more detail. The depth profiles (2.11) ascertained from the three regions (X, Y, Z) were combined to give a respective averaged depth profile (2.11) X, Y, Z (illustrated by dashed lines), and the depth profiles (2.11) determined therefrom have been illustrated in an enlarged view in partial section in FIGS. 2 to 4. Depending on the resolution of the measurement apparatus used, it is also possible for only one depth profile, in (partial) section, to be used in a representative manner for the evaluation, instead of forming an average from a plurality of depth profiles as in the present case. The illustrations in FIGS. 2 to 4 show, in each case viewed in a sectional illustration (X, Y, Z), that each indentation (2.1) has a depth profile (2.11) which comprises two opposite flank subregions (2.31) and a valley subregion (2.21) which runs between the flank subregions (2.31) and which connects the flank subregions (2.31), wherein the depth profile (2.11) is divided into a left-hand part and a right-hand part of the depth profile (2.11), wherein the depth profile (2.11) runs in an asymmetrical manner, wherein the flank subregions (2.31) and valley subregions (2.21) of the left-hand part and of the right-hand part of the depth profile (2.11) differ at least in height (h), width (b) and/or gradient (α). The sectional illustration (Y) runs, for example, through the centroid (S) of the indentation (2.1), the depth profile (2.1) being able to run in the rolling direction or transversely to the rolling direction.

The width (b) is understood to be the width between the respective highest assigned point (P1, P2) and the lowest point (P3). The height (h) is determined between the respective highest point (P1, P2) and the lowest point (P3). At these points (P1, P2, P3), it is thus possible for the depth profile (2.11) to be divided into a left-hand part and a right-hand part of the depth profile (2.11) in a defined manner, wherein the left-hand part of the depth profile (2.11) runs from the highest point (P1) to the lowest point (P3), and the right-hand part of the depth profile (2.11) runs from the highest point (P2) to the lowest point (P3). The depth profile (2.11) has an asymmetry factor A≤0.9, where A corresponds to the ratio of the integrals (Int) of the left-hand and the right-hand part of the depth profile (2.11), the integral (Int) with the larger value being the denominator of the ratio. The integrals between the points (P1, P3), left-hand part, and between points (P3, P2), right-hand part, correspond to the left-hand and right-hand area (illustrated with hatching) of the depth profile (2.11) below the depth profile function. In table 1 below, the three examined regions are compared by way of their parameters:

TABLE 1

| Region | h_P1, P3 | h_P3, P2 | b_P1, P3 | b_P3, P2 | Int_P1, P3 | Int_P3, P2 | A |
|---|---|---|---|---|---|---|---|
| X | 2.66 μm | 2.29 μm | 18.75 μm | 26.76 μm | 13.45 $\mu m^2$ | 20.68 $\mu m^2$ | 0.65 |
| Y | 2.52 μm | 2.08 μm | 20.51 μm | 26.95 μm | 16.21 $\mu m^2$ | 24.55 $\mu m^2$ | 0.66 |
| Z | 3.10 μm | 2.41 μm | 19.53 μm | 23.63 μm | 20.99 $\mu m^2$ | 14.78 $\mu m^2$ | 0.70 |

In a further examination, a process medium in the form of a forming oil was applied to the sheet steel (1, 1') according to the invention, which has in particular been coated with a metallic coat and skin-pass rolled with a deterministic surface structure (2), and it was shown that, owing to the asymmetry produced in a targeted manner along a preferred direction of the sheet steel, the process medium had accumulated in a part of the depth profile (2.11) within the indentation(s) (2.1), with the result that, in a further deep-drawing experiment, said process medium can be stocked in the necessary surface weight at the locations that are relevant to the forming process. As a reference, a dry sheet steel, that is to say a sheet steel according to the invention that was not coated with process medium, as well as several sheet steel according to the invention that were coated with a process medium with different surface weights of 0.5, 1, 1.5 and 2 g/$m^2$ in the surface structure (2), was subjected to a deep-drawing experiment under identical conditions. The result was that, as expected, the high friction force caused a high degree of abrasion in the case of the dry sheet steel, and the sheet steels coated with the process medium exhibited substantially identical results and no appreciable abrasion could be identified. It has therefore been shown that a surface weight of the process medium of 0.5 g/$m^2$ on the sheet steel which has in particular been coated and skin-pass rolled with a deterministic surface structure in accordance with the invention was sufficient to obtain a correspondingly good result.

The invention claimed is:

1. A method for producing a sheet steel skin-pass rolled with a deterministic surface structure, comprising the following steps:

providing a sheet steel, skin-pass rolling the sheet steel with a skin-pass roll, wherein the surface of the skin-pass roll which acts on the surface of the sheet steel is furnished with a deterministic surface structure such that, after the skin-pass rolling, the surface structure is impressed into the sheet steel starting from a surface of the sheet steel, wherein the surface structure has a multiplicity of indentations, wherein each indentation has an encircling flank region which leads, starting from the surface, down to a valley region, wherein, as viewed in a sectional illustration, each indentation has a depth profile which comprises two opposite flank subregions and a valley subregion which runs between the flank subregions and which connects the flank subregions, wherein the depth profile is divided into a left-hand part and a right-hand part of the depth profile, wherein the depth profile runs in an asymmetrical manner, wherein the flank subregions and valley subregions of the left-hand part and of the right-hand part of the depth profile differ in at least one of height and width, wherein, prior to the provision of the sheet steel, the sheet steel is coated by hot-dip coating, wherein the sheet steel is additionally provided with a process medium, wherein the process medium is applied with a surface weight of up to 2 g/$m^2$.

2. The method as claimed in claim 1, wherein, after the sheet steel has been skin-pass rolled, the skin-pass rolled sheet steel is coated by electrolytic coating.

3. A sheet steel skin-pass rolled with a deterministic surface structure, wherein the surface structure is impressed into the sheet steel starting from a surface of the sheet steel, wherein the surface structure has a multiplicity of indentations, wherein each indentation has an encircling flank region which leads, starting from the surface, down to a valley region, wherein, as viewed in a sectional illustration, each indentation has a depth profile which comprises two opposite flank subregions and a valley subregion which runs between the flank subregions and which connects the flank subregions, wherein the depth profile is divided into a left-hand part and a right-hand part of the depth profile, wherein the depth profile runs in an asymmetrical manner, wherein the flank subregions and valley subregions of the left-hand part and of the right-hand part of the depth profile differ in at least one of height, width and gradient, wherein the sheet steel is additionally provided with a process medium, wherein the process medium is taken up with a surface weight of up to 2 g/$m^2$ in the surface structure.

4. A method for producing a sheet steel skin-pass rolled with a deterministic surface structure, comprising the following steps:

providing a sheet steel, skin-pass rolling the sheet steel with a skin-pass roll, wherein the surface of the skin-pass roll which acts on the surface of the sheet steel is furnished with a deterministic surface structure such that, after the skin-pass rolling, the surface structure is impressed into the sheet steel starting from a surface of the sheet steel, wherein the surface structure has a multiplicity of indentations, wherein each indentation has an encircling flank region which leads, starting from the surface, down to a valley region, wherein, as viewed in a sectional illustration, each indentation has a depth profile which comprises two opposite flank subregions and a valley subregion which runs between the flank subregions and which connects the flank subregions, wherein the depth profile is divided into a left-hand part and a right-hand part of the depth profile, wherein the depth profile runs in an asymmetrical manner, wherein the flank subregions and valley subregions of the left-hand part and of the right-hand part of the depth profile differ in at least one of height and width, wherein, after the sheet steel has been skin-pass rolled, the skin-pass rolled sheet steel is coated by electrolytic coating, wherein the sheet steel is additionally provided with a process medium, wherein the process medium is applied with a surface weight of up to 2 $g/m^2$.

* * * * *